United States Patent [19]

Wise

[11] Patent Number: 4,943,247

[45] Date of Patent: Jul. 24, 1990

[54] ANNULAR ELECTRICAL TERMINAL

[75] Inventor: James H. Wise, Palmyra, Pa.

[73] Assignee: AMP Incorporated, Harrisburg, Pa.

[21] Appl. No.: 359,188

[22] Filed: May 31, 1989

[51] Int. Cl.[5] ..... H01R 11/11

[52] U.S. Cl. ..... 439/883; 439/927

[58] Field of Search ..... 439/784, 799, 860, 883, 439/889, 891, 927

[56] References Cited

U.S. PATENT DOCUMENTS

| | | | |
|---|---|---|---|
| 2,944,330 | 7/1960 | Swick | 439/883 |
| 3,278,883 | 10/1966 | Lipsey | 439/927 |
| 3,569,919 | 7/1969 | Daddona, Jr. | 339/258 |
| 3,588,787 | 5/1969 | Kindell et al. | 339/95 |
| 3,626,357 | 9/1970 | Kindell et al. | 339/95 A |
| 3,761,867 | 9/1973 | Churla | 339/98 |
| 4,063,794 | 12/1977 | Dittmann | 339/230 R |
| 4,210,379 | 7/1980 | Vachhani et al. | 339/101 |
| 4,492,422 | 1/1985 | Bieschke | 339/95 R |
| 4,605,279 | 8/1986 | Mixon, Jr. | 339/276 R |
| 4,684,191 | 8/1987 | Feher et al. | 439/246 |
| 4,795,380 | 1/1989 | Frantz | 439/860 |
| 4,845,589 | 7/1989 | Weidler et al. | 361/342 |

FOREIGN PATENT DOCUMENTS 2217822 3/1975 France .

OTHER PUBLICATIONS

Copy of Brookstone Catalog, pp. T162-B1 and 53.

*Primary Examiner*—P. Austin Bradley
*Attorney, Agent, or Firm*—Katherine A. Nelson

[57] ABSTRACT

An annular electrical terminal member 14 adapted to reduce resistance at a contact interface between two electrical articles has a fastener receiving aperture 16 extending therethrough, an inner edge 22 adjacent the fastener receiving aperture 16 and an outer edge 28 extending circumferentially therearound. A plurality of slots 26 are spaced around the annular section, the slots 26 defining therebetween respective spring sections 32 in an annular array. Each of the spring sections includes a respective protrusion 34 extending from one major surface thereof, the protrusion having a crest portion 36, the respective crest portions 36 being disposed substantially in a common plane. The crest portions 36 comprise a contact interface for electrical engagement with a common conductive surface 38 of the first electrical article 60. The other terminal major surface has an array of surface portions engageable by a second electrical article. A plurality of electrical paths in parallel are established between the first and second electrical articles 60,70 upon terminal member 14 being connected to said first and second electrical articles thereby minimizing the electrical resistance at the contact interface.

15 Claims, 4 Drawing Sheets

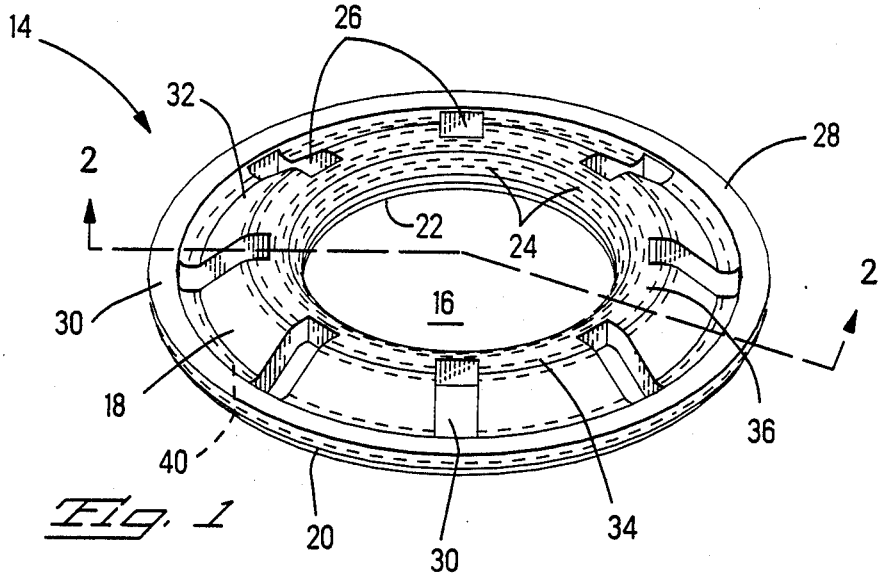
Fig. 1
Fig. 2
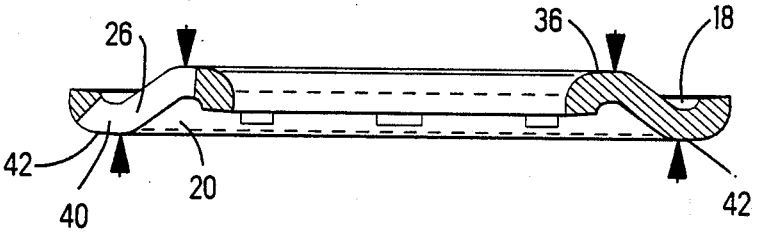
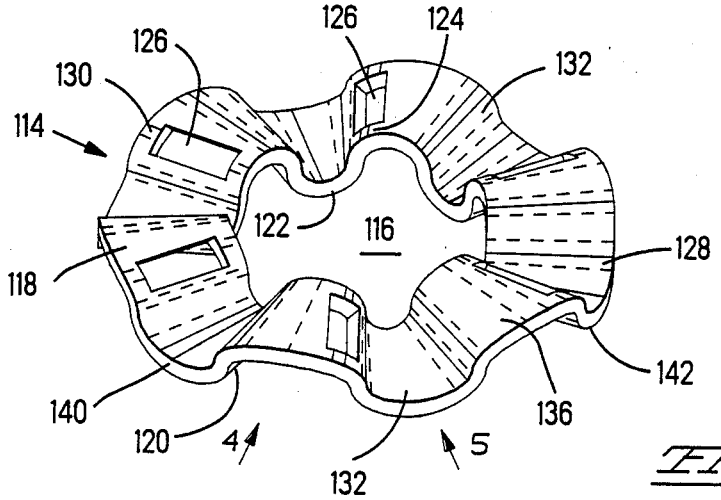
Fig. 3

Fig. 8
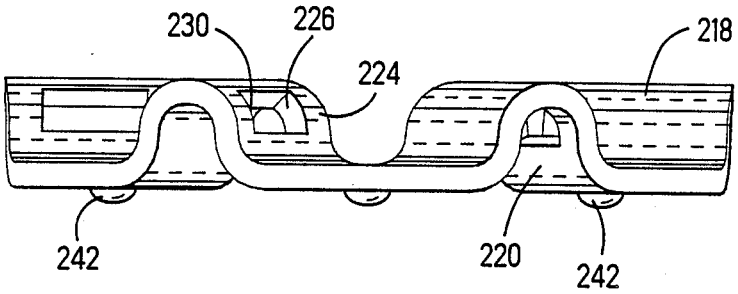
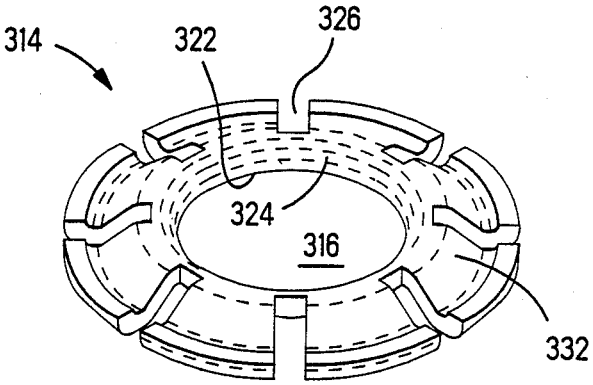
Fig. 9
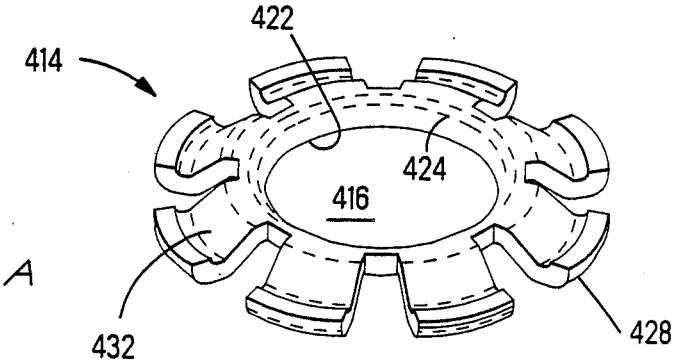
Fig. 9A

Fig. 10
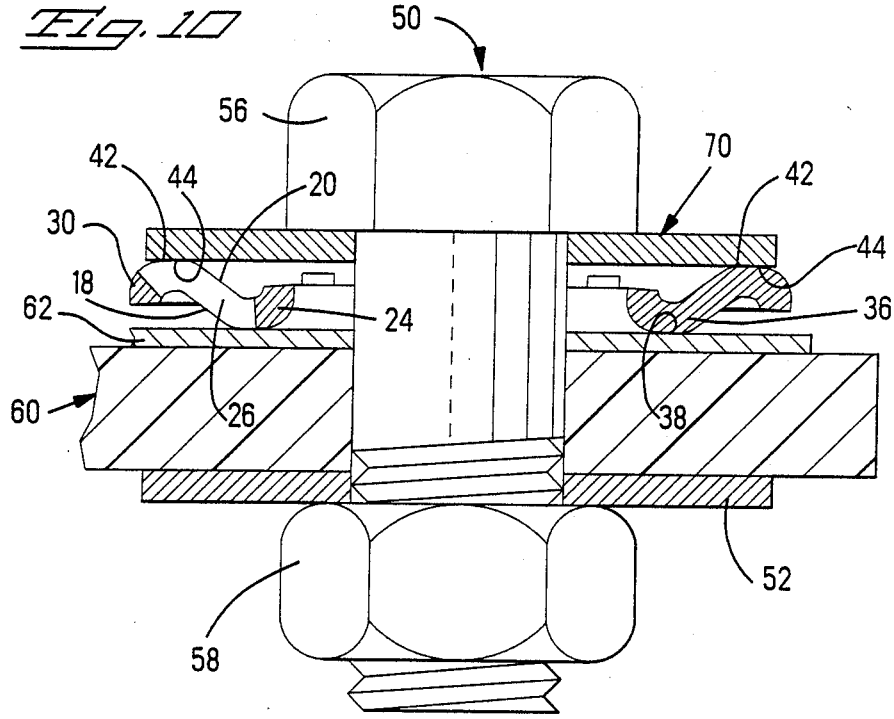
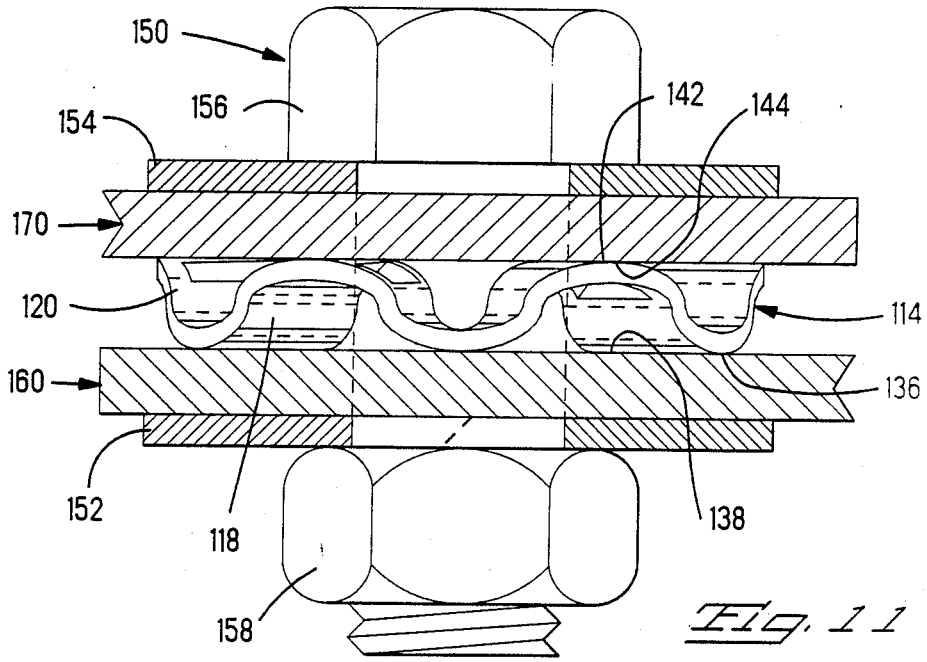
Fig. 11

ANNULAR ELECTRICAL TERMINAL

FIELD OF THE INVENTION

This invention is directed to electrical contact terminals and in particular to electrical terminals used in bolted type connections.

BACKGROUND OF THE INVENTION

This application is related to U.S. patent application Ser. No. 07/359,240 filed concomitantly herewith entitled "Electrical Terminal with Annular Section."

One typical way to effect electrical interconnection between essentially flat electrical articles, such as circuit boards, bus bars, and the like is by means of a bolted joint wherein torque is applied to the joint until a sufficiently low resistance results between the interconnected articles. Often it is necessary to apply a considerable force to the joint until a sufficiently low resistance results. The amount of torque required depends upon the electrical system in which the interconnection is being used. While a high mating torque may be applied to metal conductive members such as bus bars, the same amount of force when applied to an interconnection between a bus bar and a circuit board or two circuit boards may cause distortion of the circuit boards. It is desirable therefore to have a means to provide a low interface resistance that does not require a large amount of force applied between the two electrical articles that are being interconnected.

The area of electrical engagement between two flat articles typically is a single "circular line" of contact between the surfaces of the electrical articles or members at the joint where the bolt is attached. In actuality this "circular line" consists of a plurality of randomly located points in physical engagement and electrical contact between the corresponding surfaces. The number of points along this "line" contact depends upon the amount of force applied between the two articles, the surface finish and the flatness of the surface of the two members. It is desirable, therefore, to provide as many controlled parallel current paths as possible for the current to flow between the interconnected members.

The resistance between the mated surfaces is typically controlled by applying more force to increase the uniformity and width of the contact line or number of points in actual physical and electrical engagement between the members. The amount of force required at any one interconnection is generally determined by measuring the resistance after the interconnection is made and adjusting the force as necessary to achieve the desired results. It is desirable, therefore, to have a means whereby the amount of force required and the resistance of the interface may be calculated and predetermined before the interconnection is made.

SUMMARY OF THE INVENTION

Accordingly, to alleviate the disadvantages and deficiency of the prior art, the present invention is directed to an electrical terminal having means that provides a plurality of electrical contact paths in parallel for electrical engagement at the interface between conductive surfaces of first and second electrical articles upon being fastened therebetween It is an object of the present invention to provide multiple contact points at regular intervals along the interface between a first electrical article and a second electrical article attached thereto.

It is a further object of the present invention to provide a means whereby the normal force required to effect electrical interconnection may be predetermined.

It is another object of the present invention to provide an annular terminal for location between opposing conductive surfaces of first and second electrical articles wherein the interface resistance between the annular member and the electrical articles attached thereto is minimized and is essentially unaffected by surface imperfections.

It is an object of the invention to provide a calculable contact resistance of the mating interface between two electrical articles.

It is a further object to provide an electrical terminal having a controlled interface resistance suitable for use with electrical systems for carrying power or for carrying signals.

An additional object of the invention is to provide an electrical terminal having a controllable contact resistance that requires less normal force than equivalent terminals.

Accordingly the present invention provides an improved electrical terminal suitable for use for connecting first and second electrical articles comprising an annular member having opposed first and second major surfaces, the first and major surfaces associated respectively with the first and second electrical articles for electrically interconnecting respective conductive surfaces of the first and second electrical articles. The annular member has a centrally disposed fastener receiving aperture extending therethrough from the first major surface to the second major surface, an inner edge adjacent the fastener receiving aperture and an outer edge extending circumferentially therearound. The annular member further includes a plurality of slots spaced therearound each extending between at least one integral strap section along one of the inner edge and the outer edge. The slots define therebetween respective spring sections in an annular array. Each of the spring sections at least includes a respective protrusion extending outwardly from the first major surface and each of the respective protrusions has a crest portion. All of the respective crest portions are disposed substantially in a common plane and define an array of first contact surfaces comprising a first contact interface for electrical engagement with the conductive surface of the first electrical article upon being fastened thereto by fastening means. The second major surface at least includes an array of surface portions disposed substantially in a common plane and defining an array of second contact surfaces comprising a second contact interface for electrical engagement with the conductive surface of the second electrical article. The first and second electrical articles are secured together and biasedly held against the respective arrays of first and second contact surfaces by the fastening means, thereby compressing the spring sections and establishing contact normal force between the first electrical article and the first contact surfaces and the second electrical article and the second contact surfaces. A plurality of electrical paths in parallel are thus generated between the first electrical article and the second electrical article upon the terminal being connected between the first and second electrical articles and biasedly held together thereby minimizing the electrical resistance at the contact interfaces.

The present invention is further directed to an electrical assembly using an annular electrical terminal that provides a controllable interface resistance.

The invention itself, together with further objects and its intended advantages, will be best understood by reference to the following detailed description taken in conjunction with the following drawings.

BRIEF DESCRIPTION OF THE DRAWINGS

FIG. 1 is a perspective view of an electrical terminal made in accordance with the present invention.

FIG. 2 is a cross sectional view of the terminal of FIG. 1 taken along the line 2—2 thereof.

FIG. 3 is a perspective view of an alternative embodiment of an electrical terminal made in accordance with the invention.

FIG. 8 is a cross sectional view of the terminal of FIG. 6 taken at the location indicated by arrow 8.

FIGS. 9 and 9A are perspective views of another alternative embodiments of an electrical terminal made in accordance with this invention.

FIG. 10 is a fragmentary cross sectional view of the terminal of FIG. 1 electrically connecting first and second electrical articles.

FIG. 11 is a fragmentary cross section view of terminal of FIG. 3 electrically connecting first and second electrical articles.

DETAILED DESCRIPTION OF THE DRAWINGS

Figure 4:
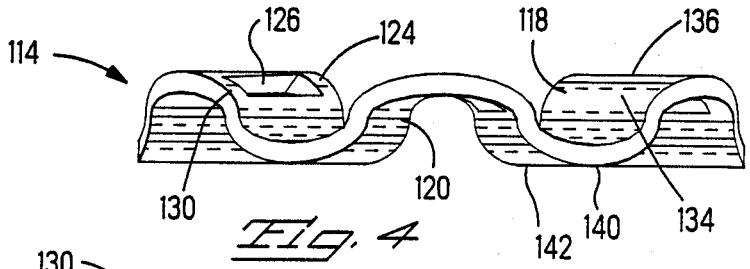
FIG. 4 is a cross sectional view of the terminal of FIG. 3 taken at the location indicated by arrow 4.

Referring now to FIGS. 1, 2, and 10, electrical terminal member 14 comprises an annular member, electrically engaging first and second electrical articles 60, 70. Annular member 14 has a centrally disposed fastener receiving aperture 16 extending therethrough from a first major surface 18 to an opposed second major surface 20. Annular member 14 has an inner edge 22 adjacent to fastener receiving aperture 16 and an outer edge 28 extending circumferentially around annular member 4. Annular member 14 further includes a plurality of slots 26 extending between first integral strap section 24 along the inner edge 22 and a second integral strap section 30 along the outer edge 28. The slots 26 define respective spring sections 32 therebetween Each spring section 32 has a respective protrusion 34 extending outwardly from the first major surface 18. Each protrusion 34 further includes a crest portion 36. Crest portions 36 extend along the angular length for a selected angular distance around the angular member 14.

In one preferred embodiment of annular member 14, all the crest portions 36 define angular segments of a common circumference interrupted and divided into portions by slots 26. All of the respective crest portions 36 are disposed substantially in a common plane and define an array of first contact surfaces comprising a contact interface 38 for electrical engagement with a common conductive surface 62 of first electrical article 60, as best seen in FIG. 10.

FIG. 10 shows annular terminal member 14 of FIG. 1 electrically engaged with conductive surface 62 on a first electrical article, shown representatively as circuit board 60 and with second electrical article shown representatively as a bus bar member 70. Member 14 is mounted to circuit board 60 by fastening means 50 comprising bolt and nut members 56, 58 respectively. Fastening means 50 is further shown being used with washer 52, to protect the lower surface of circuit board 60. It is to be understood that other types of fastening means as known in the art, such as a rivet, may also be used.

As can be seen in FIGS. 1, 2 and 10, annular member 14 has a configuration essentially equivalent to that of a Belleville washer and therefore has a sinusoidal cross section. As can be seen in FIGS. 2 and 10, second major surface 20 includes protrusion 40, which extends outwardly from surface 20 in a direction opposite to that of protrusion 34. Protrusion 40 includes an array of surface portions 42, which are disposed substantially in a common plane and are engagable by biasing means shown in FIG. 10 as bus bar 70, which is held against surface portions 42 by fastening means 50 when terminal 12 is secured between circuit board 60 and bus bar 70. Owing to the Belleville washer shape of the first contact section of terminal 12 of FIG. 10, both the washer 52, is preferably a flat members. There is no need to use a further locking washer when using annular member 14 of FIG. 1.

As torque is applied to bolt 56, pressure is applied to bus bar 70, and surface portions 42 thereby compressing spring sections 32 and establishing contact normal force between circuit board 60 and first contact surfaces at the contact interface 38. Concomitantly normal force is also applied between bus bar 70 and second contact surfaces at interface 44. The increase in pressure indicated by arrows in FIG. 2, and concomitant compression of spring members 32 causing a wiping action between crest portions 36 and the conductive surface 62 on circuit board 60 and between surface portions 42 and bus bar 70, to ensure electrical connection therewith. Each one of the plurality of spring sections 32 provides a separate electrical path thus generating a plurality of electrical paths in parallel between first electrical article or circuit board 60 and a second electrical article or bus bar upon terminal 12 being connected therebetween. This thereby decreasing the resistance of the interface.

Figure 5:
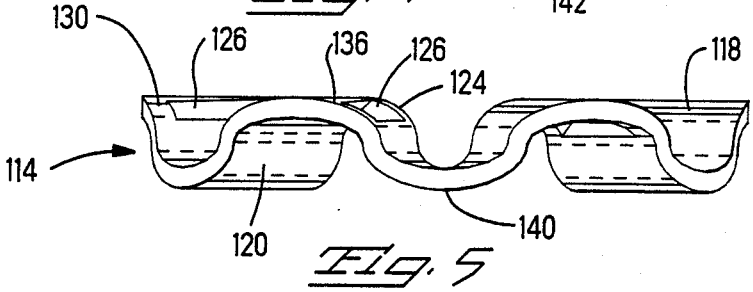
FIG. 5 is a cross sectional view of the terminal of FIG. 3 taken at the location indicated by arrow 5.

FIGS. 3, 4 and 5 shows an alternative embodiment 114 of an annular member. Annular member 114 has a Centrally disposed fastener receiving aperture 116 extending from a first major surface to a second major surface 118, 120 respectively. Annular section 114 has an inner edge 122 adjacent the fastener receiving aperture 116 and an outer edge 128 extending circumferentially therearound. A plurality of slots 126 are spaced around annular section 114, the slots 126 extending between an integral strap section 124 along the inner edge 122 and a second integral strap section 130 along outer edge 128. Annular section 114 is essentially wave shaped with slots 126 dividing section 114 into a plurality of waves having crest portions 136 extending radially outwardly from fastener receiving aperture 116. In this embodiment, terminal 110 includes a plurality of compliant beam portions 132 that extend along a selected distance around the annular circumference of annular member 114, each compliant beam section 132 being essentially separated by respective slot members 126.

FIG. 11 illustrates the use of terminal member of FIG. 3 interconnecting a first electrical article shown as conductive bus bar member 160 to a second electrical article, shown as conductive bus bar member 170. Terminal member 114 is mounted between bus bar members 160, 170 by fastening means 150 in essentially the same manner as previously described for terminal 14. Fastening means 150 comprises bolt and nut members 156,158 respectively. As can be seen from FIG. 11 the bus bar member 170 exerts pressure on the wave shaped member 114 at contact surfaces 142 on second major surface 120 thereof, thus forcing surfaces 136 into engagement against the bus bar member 160. For this embodiment fastening means 50 is used with two washers, 152 and 154, one of which needs to be a locking washer. In FIG. 11, washer 152 is shown as a split lock washer. A lock washer such as a Belleville washer may also be used. These washers, however, are not used as actual current carrying member but are used to maintain an essentially constant normal force despite temperature fluctuations that occur in the assembly when electrical load is applied.

Figure 6:
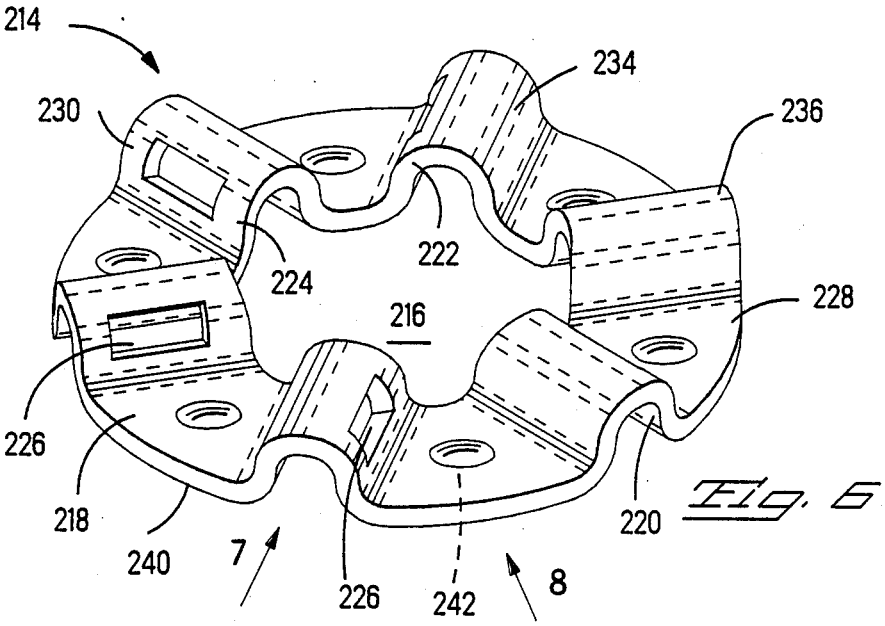
FIG. 6 is a perspective view of a further alternative embodiment of an electrical terminal made in accordance with this invention.
Figure 7:
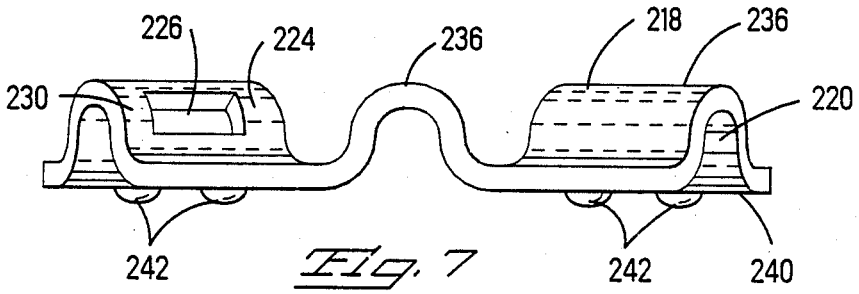
FIG. 7 is a cross sectional view of the terminal of FIG. 6 taken at the location indicated by arrow 7.

A further alternative embodiment 214 of the annular terminal member made in accordance with the invention is illustrated in FIGS. 6, 7 and 8. The first contact surfaces 236 of this terminal are similar to that of terminal 114 of FIG. 2 in that the first major surface 218 of this terminal has the plurality of wave shaped portions having contact surfaces that extend radially outwardly from the center fastener receiving aperture 216. The second major surface 220 of the terminal includes a plurality of outwardly extending flattened wave-type sections, each having a respective dimple member 242. Dimple members 242 are compressible under pressure to comprise a plurality of contact surfaces 242 between the terminal and a biasing means such as a washer or a common conductive surface of a first electrical article.

FIGS. 9 and 9A illustrates a further embodiments 314, 414 of annular terminal member made in accordance with the invention. In the embodiment of FIG. 4, annular member 314 comprises a plurality of compliant beam portions 332 that are interconnected only at one end instead of two as are the beams in the embodiments shown in FIGS. 1–8. FIG. 9A illustrates annular terminal member 414 which is similar to that of FIG. 9 but having slots 426 that are configured to keep beams 432 at essentially a constant width as they extend radially outwardly form inner strap portions 424 adjacent fastening aperture 416. While FIG. 9 shows the beams 332 interconnected at the inner edge 322 of the fastener receiving aperture 316 and not at the outer edge 328, it is to be understood that beams 332, 432 could be connected at the outer edge 328, 428 instead of the inner edge 322, 422 respectively.

In accordance with the invention annular terminal members 14, 114, 214 and 314 provide a plurality of contact sections essentially equivalent to compliant beam portions to provide a plurality of contact points for interconnecting contact surfaces of a first and second electrical articles. The resistance at the contact interface of a particular interconnection can be varied by changing the number of slots in the annular body portion and thereby the number of spring arms in the corresponding terminal member. The greater the number of parallel electrical paths, the lower the resistance is through the terminal. Since each one of the sections provides a contact surface, sufficient torque needs to be applied only to bring the sections into physical contact and electrical engagement with the opposed surface. It should also be recognized that the terminal embodiments wherein both ends of the contact beams are joined by respective strap sections essentially act as a single spring member having a plurality of sections thus providing for a more equalized application of force than may be achievable with the plurality of separate spring arm members.

As can be appreciated, the Belleville washer type structure of annular terminal member 14 can be subdivided into a greater number of contact sections than the wave shaped contact sections of annular members 114 and 214 respectively. By increasing the number of contact sections of terminal 14, the normal force required to maintain electrical engagement between the annular terminal member and first and second electrical articles is reduced thus making the terminal configuration of FIG. 1 particularly suitable for use with circuit boards without causing distortion of the board. It is to be understood however that all of the terminal members of the present invention may be used with electrical articles such as bus bars and circuit board members. In determining the number of sections into which the first connecting portion is to be subdivided, it is necessary to know the desired electrical characteristics of the contact interface for the particular electrical system being designed. The use of multiple contact points at regular intervals separated by slots in a radial pattern provides substantially independent current paths. The pattern allows more accurate determination of the resistance at the interface than is possible in the prior art.

Terminals made in accordance with the invention are suitable for use with signal and power systems When used in signal systems, the terminal can be made of materials such as phosphor bronze, and the like. When used with power systems, stock thicknesses generally are in the range of 0.020 to 0.060 inches. The thickness of the stock and the conductive material used for the stock will depend upon the amount of load placed through the terminal. Preferably the terminals made in accordance with this invention are stamped and form members from the selected stocked material.

In designing the mating portion of a terminal to be interconnected to a flat member by means of a bolt, it is most desirable to have a plurality of contact paths to a plurality of contact points between a connecting member and an electrical article. This is particularly important when terminals are used for power distribution systems where high current is being conducted between the first and second electrical articles. The multiple contact points provide an equalized flow of current through the terminal In addition the multiple contact points made in accordance with the invention have a low resistance through the interface.

As can be seen from the previous description the current invention replaces typical flat ring type members that generate a single circular line of contact between mating surfaces with multiple contact points provided in a random pattern. The multiple electrically parallel beam configuration allows the amount of resistance to be determined and in addition the forces needed to accurately achieve the desired amount of contact area. The present design also permits the use of thinner and more flexible materials for carrying an equivalent amount of current than was hereto possible Since the amount of contact area can be accurately determined and the constriction resistance of the interface minimized, and the normal force required to effect interconnection reduced, it is no longer necessary to use fixed stocked materials that are sufficient to withstand high normal force previously to effect a sufficient contact area through the interface The present invention also provides a means to design a terminal which is sized to carry a specified amount of current. The present invention provides a means whereby materials having strong spring characteristics may be used to effect a plurality of contact points in a cost effective manner.

It is thought that the annular electrical terminal of the present invention and many of its attendant advantages will be understood from the foregoing description. It will be apparent that various changes may be made in the form, construction and arrangement of the parts thereof without departing from the spirit or scope of the invention or sacrificing all its material advantages. The form herein described is merely a preferred or exemplary embodiment thereof.

What is claimed is:

1. An improved electrical terminal suitable for use in connecting a first electrical article to a second electrical article comprising:

an annular member having opposed first and second major surfaces, said first and second major surfaces associated respectively with said first and second electrical articles for electrically interconnecting respective conductive surfaces of said first and second electrical articles;

said annular member having a centrally disposed fastener receiving aperture extending therethrough from said first major surface to said second major surface, said annular member having an inner edge adjacent said fastener receiving aperture and an outer edge extending circumferentially therearound;

said annular member further including a plurality of slots spaced therearound each extending between at least one integral strap section along one of said inner edge and said outer edge, said slots defining therebetween respective spring sections in an annular array, each of said spring sections at least include respective protrusions extending outwardly from one of said first and second major surfaces, each said respective protrusion having a crest portion, all of said respective crest portions being disposed substantially in a common plane and defining an array of first contact surfaces comprising a first contact interface for electrical engagement with said conductive surface of said first electrical article upon being fastened thereto by fastening means; and the other of said first and second major surfaces at least including an array of surface portions disposed substantially in a common plane and defining an array of second contact surfaces comprising a second contact interface for electrical engagement with said conductive surface of said second electrical article, said first and second electrical articles being secured together and biasedly held against said respective connecting portions by said fastening means, thereby compressing said spring sections and establishing contact normal force between said first electrical article and said first contact surfaces and said second electrical article and said second contact surfaces; whereby a plurality of electrical paths in parallel are generated between said first electrical article and said second electrical article upon said terminal being connected between said first and second electrical articles thereby minimizing the electrical resistance at the contact interfaces.

2. An electrical assembly comprising first and second electrical articles electrically interconnected by means of the electrical terminal of claim 1.

3. The electrical terminal of claim 1 wherein said spring sections extend radially outwardly from said inner strap section.

4. The improved electrical terminal of claim 1 further including a second integral section along the other of said inner and said outer edge.

5. The electrical terminal of claim 4 wherein said spring sections extend radially outwardly from said inner strap section.

6. The electrical terminal of claim 5 wherein said spring sections extend along a selected distance around the annular circumference of said annular member.

7. An electrical assembly comprising:

a first electrical article having a first conductive surface thereon;

a second electrical article having a second conductive surface thereon; and an annular member having opposed first and second major surfaces, said first and major surfaces associated respectively with said first and second electrical articles for electrically interconnecting respective conductive surfaces of said first and second electrical articles;

said annular member having a centrally disposed fastener receiving aperture extending therethrough from said first major surface to said second major surface, said annular member having an inner edge adjacent said fastener receiving aperture and an outer edge extending circumferentially therearound;

said annular member further including a plurality of slots spaced therearound each extending between at least one integral strap section along one of said inner edge and said outer edge, said slots defining therebetween respective spring sections in an annular array, each of said spring sections at least include respective protrusions extending outwardly from one of said first and second major surfaces, each said respective protrusion having a crest portion, all of said respective crest portions being disposed substantially in a common plane and defining an array of first contact surfaces comprising a first contact interface for electrical engagement with said conductive surface of said first electrical article upon being fastened thereto by fastening means; and the other of said first and second major surfaces at least including an array of surface portions disposed substantially in a common plane and defining an array of second contact surfaces comprising a second contact interface for electrical engagement with said conductive surface of said second electrical article, said first and second electrical articles being secured together and biasedly held against said respective connecting portions by said fastening means, thereby compressing said spring sections and establishing contact normal force between said first electrical article and said first contact surfaces and said second electrical article and said second contacts surfaces; whereby a plurality of electrical paths in parallel are generated between said first electrical article and said second electrical article upon said terminal being connected between said first and second electrical articles thereby minimizing the electrical resistance at the contact interfaces.

8. The electrical assembly of claim 7 wherein said spring sections of said annular member extend radially outwardly from said inner strap section.

9. The electrical assembly of claim 7 wherein at least one of said first and second electrical articles is a circuit board.

10. The electrical assembly of claim 7 wherein at least one of said first and second electrical articles is a metal member.

11. The electrical assembly of claim 7 wherein said annular member further includes a second integral section along the other of said inner and said outer edge.

12. The electrical assembly of claim 11 wherein said spring sections extend radially outwardly from said inner strap section.

13. The electrical assembly of claim 11 wherein said spring sections of said annular member extend along a selected distance around the annular circumferential thereof.

14. The electrical assembly of claim 11 wherein at least one of said first and second electrical articles is a circuit board.

15. The electrical assembly of claim 11 wherein at least one of said first and second electrical articles is a metal member.

* * * * *